US007552812B2

(12) United States Patent
González Alemany et al.

(10) Patent No.: US 7,552,812 B2
(45) Date of Patent: Jun. 30, 2009

(54) SAFETY DEVICE FOR MOVING HANDRAILS

(75) Inventors: Miguel Angel González Alemany, Mierer (ES); Juan Domingo Gonzalez Pantiga, Gijón (ES); Manuel Alonso Cuello, Gino (ES); José Mendiolagoitia Juliana, Gijón (ES)

(73) Assignees: Thyssenkrupp Norte, S.A., Asturias (ES); Thyssennkrupp Elevator (ES/PBB) Ltd., London (GB)

( * ) Notice: Subject to any disclaimer, the term of this patent is extended or adjusted under 35 U.S.C. 154(b) by 38 days.

(21) Appl. No.: 11/966,500

(22) Filed: Dec. 28, 2007

(65) Prior Publication Data

US 2008/0185264 A1 Aug. 7, 2008

(30) Foreign Application Priority Data

Dec. 29, 2006 (ES) ..... 200603325

(51) Int. Cl.
*B66B 23/22* (2006.01)

(52) U.S. Cl. ..... 198/338; 198/323

(58) Field of Classification Search ..... 198/323, 198/337, 338

See application file for complete search history.

(56) References Cited

U.S. PATENT DOCUMENTS 3,809,206 A * 5/1974 Bredehorn et al. ..... 198/323
3,934,699 A * 1/1976 Saito et al. ..... 198/323
4,619,355 A * 10/1986 Adrian et al. ..... 198/323
4,924,995 A * 5/1990 Adrian et al. ..... 198/338
5,332,078 A 7/1994 Johnson et al.
5,366,060 A * 11/1994 Johnson et al. ..... 198/338
5,443,145 A * 8/1995 Schoeneweiss ..... 198/338
5,465,823 A * 11/1995 Schoeneweiss ..... 198/338
6,367,608 B1 4/2002 Franceschi

FOREIGN PATENT DOCUMENTS

EP 1 046 606 10/2000
GB 2 255 651 11/1992
JP 2004-224553 8/2004

* cited by examiner

*Primary Examiner*—James R Bidwell
(74) *Attorney, Agent, or Firm*—Merchant & Gould P.C.

(57) ABSTRACT

The invention relates to a safety device for moving handrails consisting of a stop (5), arranged at the entrance of the handrail (1) assembled on a fixed railing (3) finishing the handrail, the stop (5) being connected to a rod (7) which can move longitudinally and is retractable against a spring (9), the device comprising a hinged outer lid (15) having locking pawls (19) for an inner lid (18), such that the outer lid (15) automatically tends to the open position due to the effect of the springs (17) affecting the hinge (16) when the stop (5) is retracted and the lock (10) of the latter are released, whereas the inner lid (18), upon being released, also tends to the open position by simple gravity. In this way when a user does not let go of the handrail (1) when it penetrates the railing (3), he or she drives the stop (5) with his or her hand and the lids (15) and (18) are automatically opened, preventing injury to the hand of the user and causing the stop of the handrail through a microswitch (23).

5 Claims, 6 Drawing Sheets

SAFETY DEVICE FOR MOVING HANDRAILS

FIELD OF THE INVENTION

The present invention relates to a safety device, especially designed for its use in moving handrails, specifically for handrails used in mechanical stairs or walkways and moving simultaneously with the latter.

The object of the invention is to provide said handrails with a safety device preventing the hands of the users from being trapped in the place where the actual handrail is concealed, at the exit of the walkway of stairs, to return in an also concealed manner to the start of the stairs or walkway.

The invention is thus comprised in the scope of mechanical stairs or walkways, such as those used in airports, department stores, etc.

BACKGROUND OF THE INVENTION

Both in the case of walkways and mechanical stairs, either the moving platform for transporting persons or objects or the steps, move accompanied in a synchronized manner by a handrail aiding in the corporal stability of the user when it is driven by the moving surface on which it rests.

There are different structural solutions for the actual handrail, one of such solutions consisting of an alignment of handgrip-carriages, which at the end of the walkway or of the mechanical stairs are concealed under a fixed structure or railing, where said handgrip-carriages undergo a 180° inflexion in their path, to again return to the start of the walkway or stairs, carrying out this return path in a concealed condition, to access the work line through another railing similar to the exit railing.

The mentioned exit railing is usually provided, in correspondence with the entrance opening for the moving handrail, with an inclined plane or ramp tending to separate the hand of the user from the handgrip-carriage which he or she is holding at the critical time in which the handrail penetrates the railing, in order to prevent accidents due to the "pinching" of the hand between the mentioned fixed and moving elements from occurring.

However, said inclined plane is not enough to provide the handrail with the sufficient safety, and practice shows that these types of accidents can occur.

SUMMARY OF THE INVENTION

The safety device proposed by the invention fully and satisfactorily solves the problems previously set forth, offering full guarantees under any circumstance, so that if for any reason the user does not let go of the handrail at the time in which the holding area thereof penetrates the railing, said railing opens at the same time that the movement of the handrail is interrupted, whereby the mentioned pinching effect is impossible.

To that end and more specifically, the device proposed by the invention initially consists of a pair of sensors located in front of a moving stop emerging substantially from the railing in the area for accessing the latter, by the actual handrail. The function of said sensors is to detect the presence of a hand of the user located close to the entrance of the handrail. In the event of a positive detection, the user would be warned that he or she is approaching the entrance of the handrail by means of an acoustical signal. In addition, the stop has a classic inclined plane in order to make the release of the hand of the user easier, but in the event that said release does not occur it is driven by the hand itself towards the inside of the railing, incorporating a pair of complementary lowerable lids, which are normally kept locked to the fixed part of the railing and which are released by the longitudinal movement of the mentioned stop, automatically passing to the open position, the outer lid due to the effect of a hinge provided with springs. The inner lid has the particularity that it moves simply by gravity, rotating according to a rotating shaft parallel to the rotating shaft defined by the hinge of the outer lid, the lid moving vertically with respect to the railing, the mentioned inner lid being concealed inside the railing such that upon opening the device, the mentioned inner lid does not invade the use area of the handrail and thus the possibility of hitting the user in the opening movement is prevented.

In order to achieve this effect, the mentioned front stop is associated to a longitudinal rod which can move in this direction against a spring and with which a runner with wheels sliding on the base of the bed is integral, and the wheels of which move in housings finished in an upper opening, such that when said opening is reached the runner can swing together with the outer lid, which swings towards the open position due to the effect of the hinge with springs.

The inner lid is released simultaneously, which lid was previously retained by moving pawls assembled on one of the perforated partitions forming part of the outer lid, releasing it when said outer lid is swung, such that the inner lid also swings towards the open position with the collaboration of complementary guides and wheels, the inner part of said inner lid moving downwards below the level of the modular guide.

According to another of the features of the invention, an electric microswitch is assembled on the runner with wheels, which microswitch acts as a switch in the power supply of the drive unit of the handrail, this micro normally remaining closed as it is supported on the base of the railing, and such that when the runner swings upwards the micro is separated from the mentioned base, it interrupts the circuit in which it is installed and causes the instantaneous stop of the mechanical stairs or walkway.

According to the described structure, the moving parts of the railing, i.e. the lids thereof are automatically opened when the hand of a user attempts to access its inside, whereby eliminating the risk of accident, at the same time that the mechanical stairs or walkway interrupt their movement, being ready to be reset by simply closing the mentioned lids, to one of which there is associated an opening sensor to confirm that said closing has been suitably carried out, said sensor allowing the new and normal operation of the actual handrail and of the mechanical stairs or walkway associated thereto.

BRIEF DESCRIPTION OF THE DRAWINGS

To complement the description being made and for the purpose of aiding to better understand the features of the invention according to a preferred practical embodiment thereof, a set of drawings is attached as an integral part of said specification, in which the following has been shown with an illustrative and non-limiting character.

DETAILED DESCRIPTION OF THE PREFERRED EMBODIMENT(S)

Figure 1:
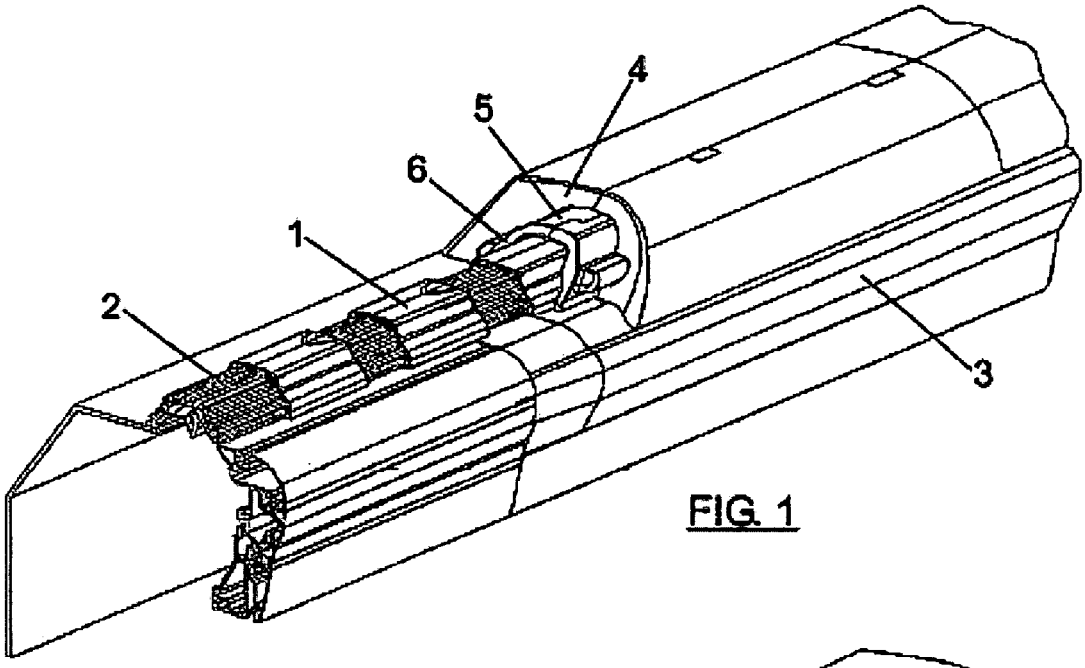
FIG. 1 shows a partial perspective view of a moving handrail provided with the safety device forming the object of the present invention in a normal work position and partially sectioned in order to show its structure with greater clarity.
Figure 2:
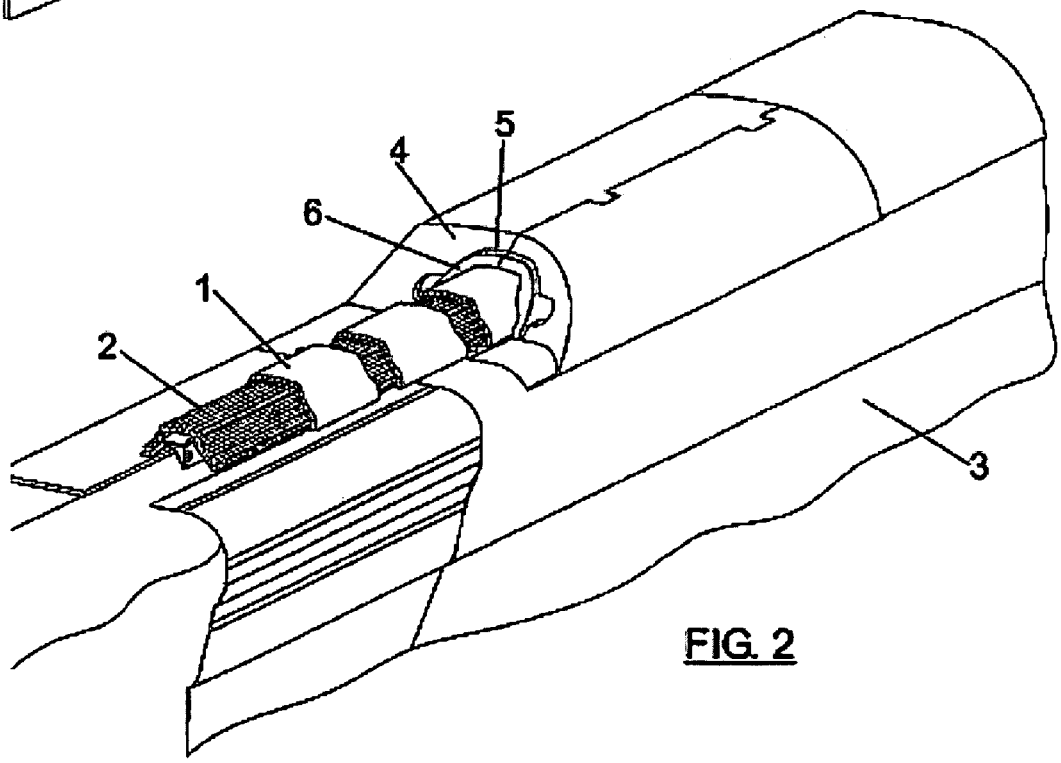
FIG. 2 shows, according to a depiction similar to that of the previous figure, the same assembly of said figure in the initial activation stage of the safety device.
Figure 3:
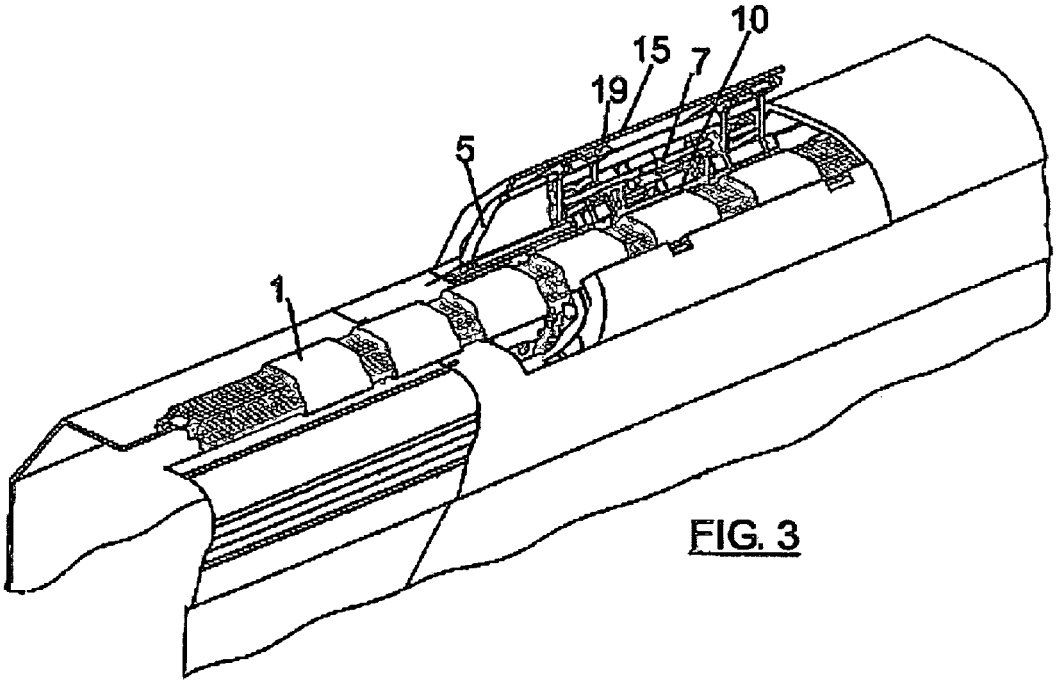
FIG. 3 again shows a depiction similar to that of the previous figures, with the safety device in the final activation stage, with its outer lid open but its inner lid still closed.
Figure 4:
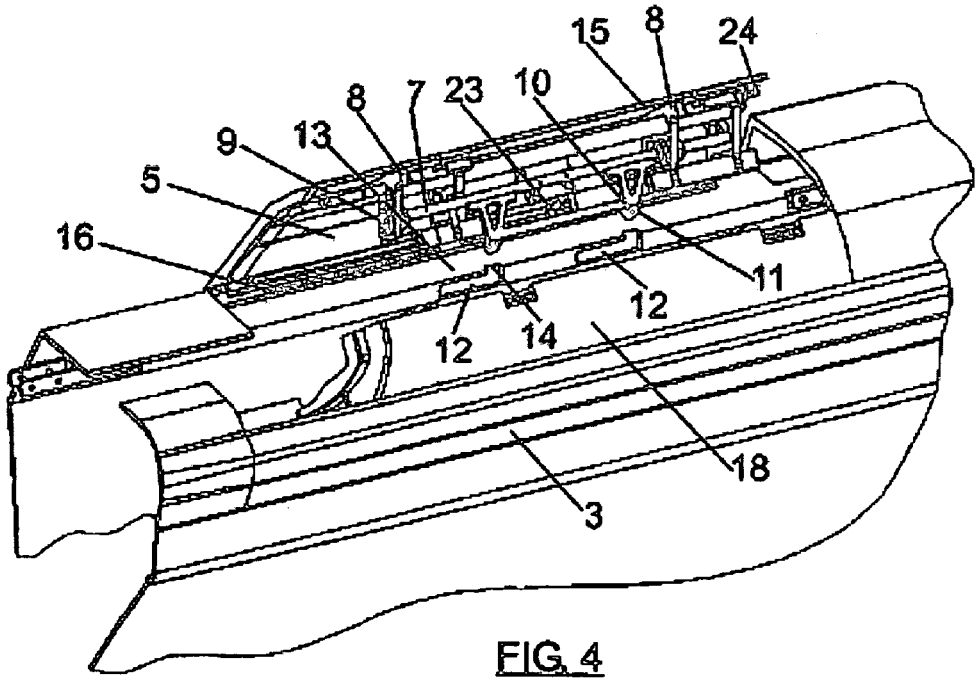
FIG. 4 shows an enlarged detail of the previous figure in which the actual handrail has been eliminated for the sake of greater clarity of the safety device of the invention.
Figure 5:
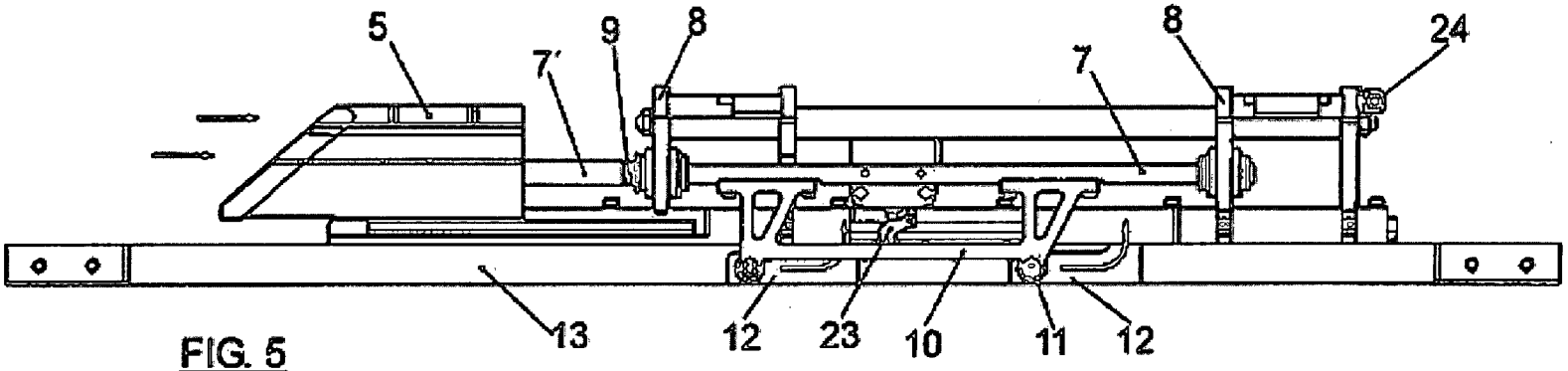
FIG. 5 shows a side elevational view of the safety device without its lids in a normal work position thereof.
Figure 6:
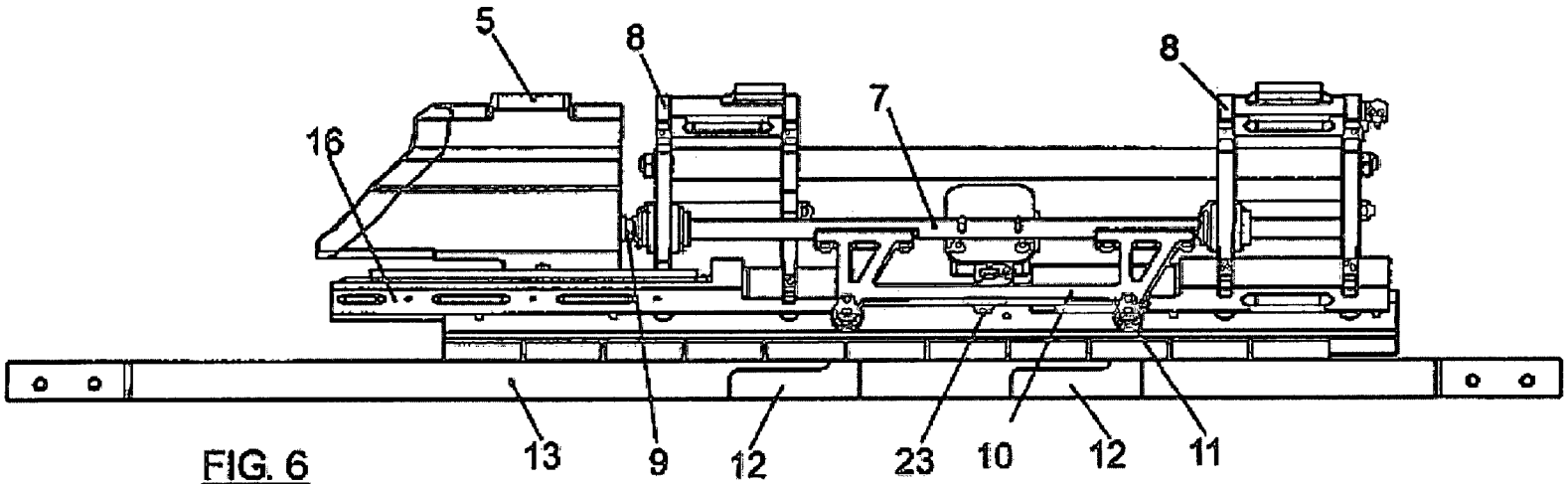
FIG. 6 shows a depiction similar to that of FIG. 5, but corresponding to the activation position of the device, in which its outer lid has been opened.
Figure 7:
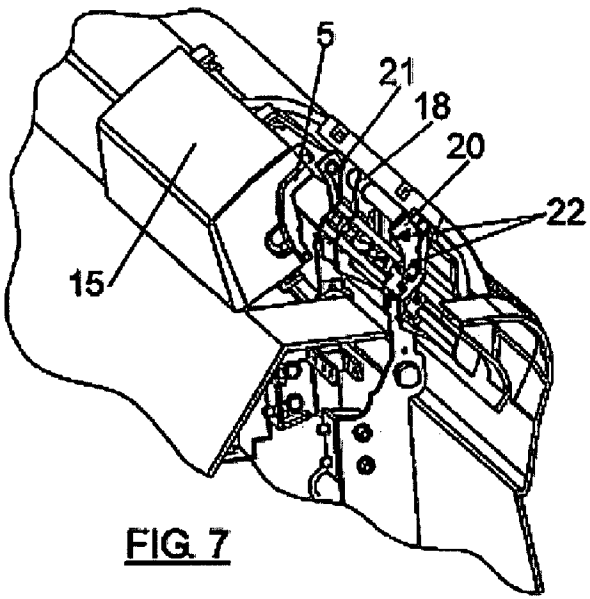
FIG. 7 shows a perspective view of another detail of the device, in contrast to that of FIGS. 1 to 4, in which the inner lid appears open.
Figure 8:
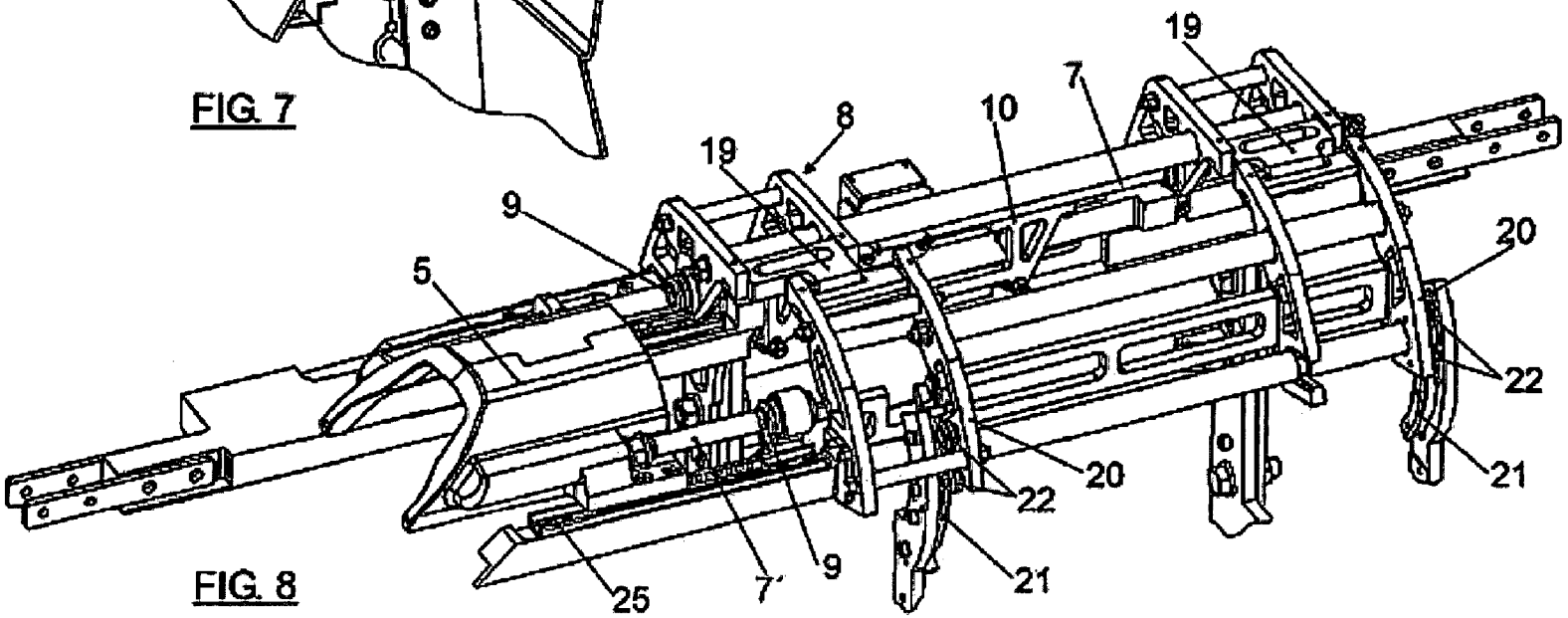
FIG. 8 shows a general perspective view of the device in which the outer part has not been shown in order to show its structure with greater clarity, and in the rest position thereof, that corresponding to the normal work position of the mechanical stairs or walkway.

The indicated figures have shown a handrail of the type commonly used in mechanical stairs and walkways in which there are moving handgrips (1) by way of handgrip-carriages which can move on a modular guide (2) covered by them, said moving handgrip penetrating at its exit end a fixed railing (3) in which the return of said moving handgrip (1) occurs, to reach the entrance railing of the walkway or stairs in a concealed manner and restart the operating cycle.

Starting from this basic and conventional structure, the device of the invention is based on the arrangement, in correspondence with the opening (4) through which the actual handrail penetrates the railing (3), of a moving stop (5) having an inclined front plan (6) so that separation of the hand of the users with respect to the moving handgrip (1) is achieved.

This moving stop (5) can be retracted towards the inside of the railing (3) when for any reason, the user does not let go of the moving handgrip (1) and it is integral with a longitudinal rod (7) suitably guided along the railing (3) by means of perforated partitions (8), the mentioned stop (5) being retractable against the tension of a spring (9) extending between the stop (5) and the first partition (8), and the rod (7) being integral with a runner (10) provided with wheels (11) which can move in respective housings (12) of the fixed base (13) of the railing or can emerge to the outside through an end opening (14).

Figure 9:
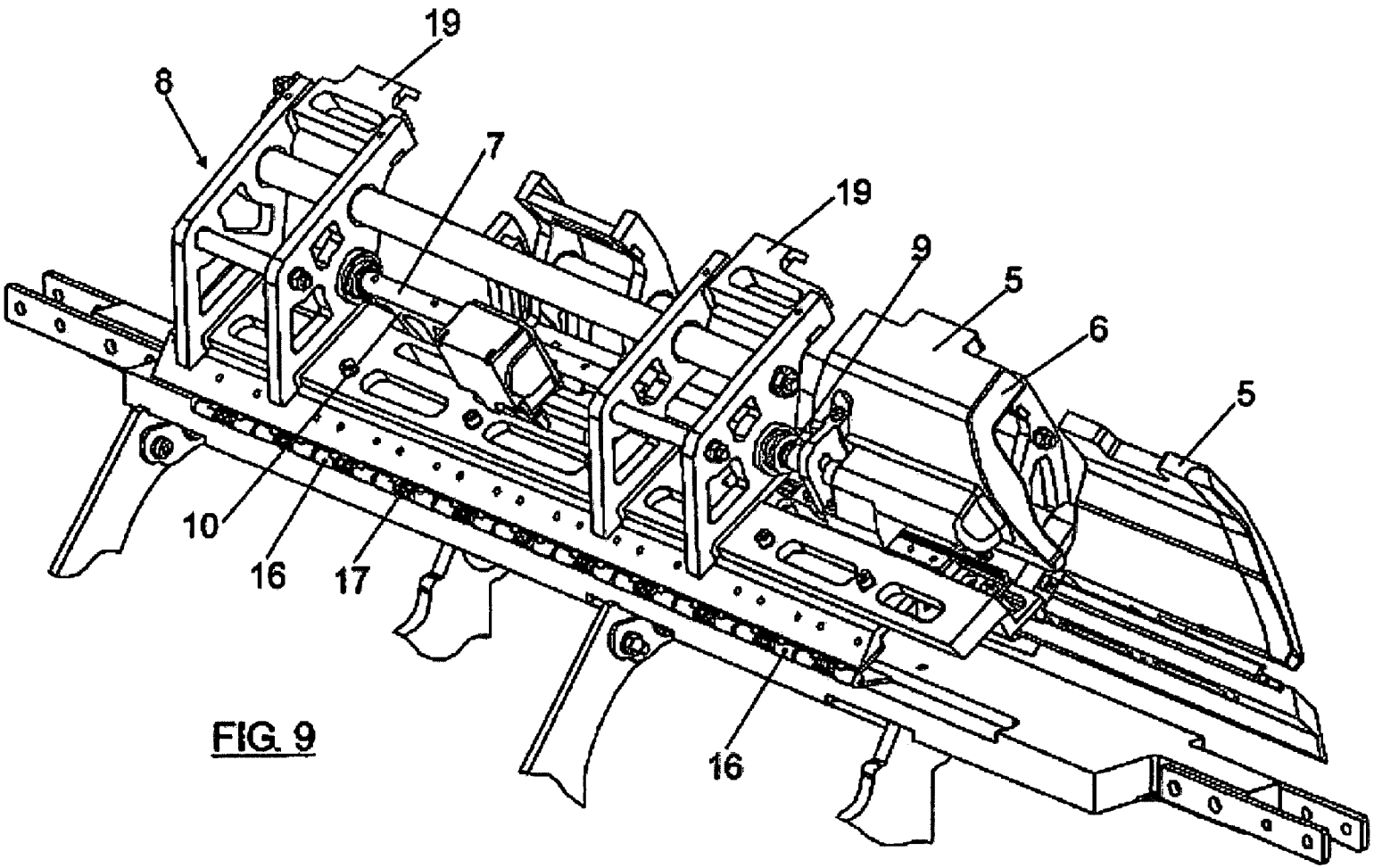
FIG. 9 finally shows a perspective view of a detail of the device, also without its outer part being shown, in which the hinge corresponding to the outer lid is shown with greater detail.

Both the front stop (5) and the rod (7), the runner (10) and the partitions (8) are associated to an outer lid (15) assembled on the fixed part of the railing (3) and have the possibility of swinging with respect to said railing through a hinge (16) which, as is especially shown in the detail of FIG. 9, is aided by a plurality of springs (17) tending to automatically open the lid (15) when such lid is released by the movement of the runner (10) and its wheels are released with respect to the housings (12). The front stop (5) will also be able to be divided into two parts which can swing together with the outer lid (15) or independently thereto in order to be able to access the handrail in the event of a failure.

The swinging outer lid (15) is complemented with another inner lid (18) which is normally maintained in a closed position due to the effect of a pair of pawls (19) which can also be moved by the stop (5) since they are assembled on the perforated partition (8) of the outer lid (15), which is connected to the rod (7), the inner lid (18) having an inner framework (20) supporting it, which can pass from a closed position to an open position with the collaboration of guides (21) on which wheels (22) arranged in the framework (20) can slide.

Figure 10:
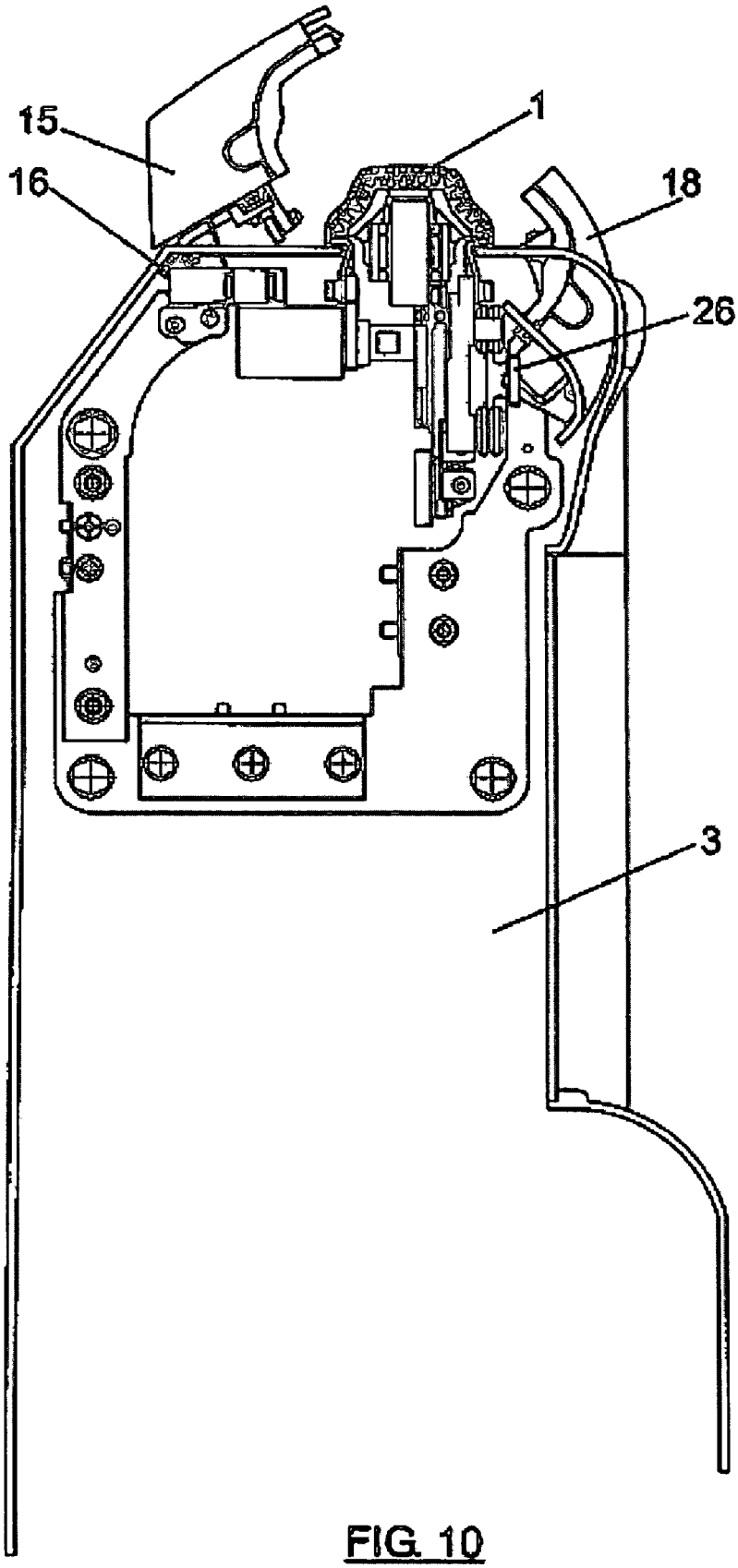
FIG. 10 shows a cross-sectional view according to a section plane perpendicular to the direction of movement of the handrail.

FIG. 10 shows how the inner lid (18) and outer lid (15) are arranged once the device has been opened. As can be observed in said figure, the outer lid (15) is lowered according to a shaft parallel to the hinge (16), the inner lid (18) is in turn lowered or rotated according to a shaft (26) parallel to the shaft (16) and vertically moved with respect to said shaft, such that the lowering of the inner lid (18) makes such lid, as a result of the collaboration of the guides (21) associated to the railing (3), be partially concealed in the outer casing of the railing (3).

The inner lid (18) has a second rod (7') parallel to the rod (7) of the outer lid (15) which moves longitudinally and together with the mentioned rod (7).

The moving stop (5) retracts as a result of a sliding thereof on respective tracks (25) which are respectively jointed to the partition (8) of the outer lid (15) closest to the moving stop (5) and to the front framework (20) of the inner lid (18).

Returning again to the runner with wheels (10), it simultaneously forms the support for an electric microswitch (23) which is kept closed in a normal work position of the handrail, being supported on the mentioned base (13), but when the lid (15) swings towards the open position it loses contact with said base (13), it automatically passes to the open position and interrupts the power circuit both of the handrail itself and of the complementary mechanical stairs or walkway.

In order to reset the system the inner (18) and outer (15) lids will be manually closed. When this occurs, a sensor (24) is available which will confirm the closing of the entrance of the handrail and will allow the operation of the walkway again. The front stop (5) returns to its original position as a result of the compression springs (9) acting thereon, driving with it the rod (7) with the runner (10) and the micro (23) since they are components integrally joined to the front stop (5).

The device also has sensors (not shown in the figures) which in the present embodiment are located in front of the moving stop (5) for the purpose of detecting the presence of a hand of the user located close to the entrance of the handrail and in the event of a positive detection, to warn the user by means of an acoustical signal.

The invention claimed is:

1. A safety device for moving handrails such as those used in transport systems comprising mechanical stairs and walkways, wherein said handrail, at one exit end of the handrail, penetrates an inside of a hollow and fixed railing, the device of which comprises:

an opening for accessing the inside of the railing;

a stop:

in correspondence with the opening;

retractable against the tension of a spring;

a longitudinal rod integral with the stop;

an outer lid assembled on the fixed part of the railing which is laterally lowerable with respect to the latter between an open position and a closed position;

an inner lid assembled on the fixed part of the railing which is laterally lowerable with respect to the latter between an open position and a closed position, connected to the outer lid so that the inner lid and the outer lid are opened together;

wherein:

the longitudinal rod and the stop are associated, with the possibility of longitudinal movement, to the outer lid, said longitudinal rod comprising locking means for the mentioned lid in a closed position;

wherein the outer lid comprises a moving structure which can move with the rod, with which a pair of pawls are integral, which pawls lock the inner lid having an inner framework, the inner lid in turn having inner wheels associated to the mentioned framework, which wheels slide on guides integral with the railing, the guides of which have a circular arc shape and a path such that they allow opening the mentioned inner lid by gravity, the lid moving vertically with respect to the railing following the path of the guides, the mentioned inner lid being concealed in the inside the mentioned railing in the open position of the device.

2. The device of claim 1, wherein the locking means of the outer lid comprise a runner with wheels integral with the rod, the wheels of which move in housings of a fixed base of the railing, which housings are longitudinally elongated and finished in end exits for the wheels at the time of releasing the outer lid, which automatically tends to the open position due to the effect of the springs aiding a hinge through which the outer lid is connected to the fixed part of the railing.

3. The device according to claim 2, wherein the runner with wheels forms a support for an electric microswitch impinging on the fixed base of the railing in a closed position of the lids, remaining in a closed position, and when the outer lid is opened, it is separated from said base and passes to an open position, interrupting the power circuit of the mechanical stairs or walkway associated to the handrail.

4. The device of claim 1, wherein one of the lids of the railing, preferably the outer lid, incorporates an opening sensor in order to allow reestablishing the power supply of the mechanical stairs or walkway after resetting the device when the lids are duly closed.

5. The device of claim 1, wherein in comprises a pair of sensors located in front of a moving stop in order to detect the presence of a hand of a user located close to the entrance of the handrail and in the event of a positive detection, to warn the user by means of an acoustical signal.

* * * * *